US006489965B1

(12) United States Patent
Voorhies

(10) Patent No.: US 6,489,965 B1
(45) Date of Patent: Dec. 3, 2002

(54) SYSTEM, METHOD AND COMPUTER PROGRAM PRODUCT FOR ALTERING SATURATION IN A COMPUTER GRAPHICS PIPELINE

(75) Inventor: Douglas A. Voorhies, Menlo Park, CA (US)

(73) Assignee: nVIDIA Corporation, Santa Clara, CA (US)

( * ) Notice: Subject to any disclaimer, the term of this patent is extended or adjusted under 35 U.S.C. 154(b) by 117 days.

(21) Appl. No.: 09/637,476

(22) Filed: Aug. 11, 2000

(51) Int. Cl.[7] ..... G09G 5/04
(52) U.S. Cl. ..... 345/589; 345/590
(58) Field of Search ..... 345/589, 600, 345/590, 207, 690, 63, 77, 601, 602

(56) References Cited

U.S. PATENT DOCUMENTS 5,534,915 A * 7/1996 Sandrew ..... 348/29
5,568,284 A * 10/1996 Oku et al. ..... 358/518

* cited by examiner

*Primary Examiner*—Matthew Luu
(74) *Attorney, Agent, or Firm*—Silicon Valley IP Group, LLC.; Kevin J. Zilka

(57) ABSTRACT

A system, method and computer program product are provided for improving display characteristics in a computer graphics pipeline. Initially, color data is received from memory of the computer graphics pipeline. Thereafter, the saturation and/or sharpness of the color data is altered for improving display characteristics. Next, the color data is outputted for being displayed by a display device.

26 Claims, 4 Drawing Sheets

SYSTEM, METHOD AND COMPUTER PROGRAM PRODUCT FOR ALTERING SATURATION IN A COMPUTER GRAPHICS PIPELINE

FIELD OF THE INVENTION

The present invention relates to computer graphics, and more particularly to improving display characteristics in a computer graphics processing pipeline.

BACKGROUND OF THE INVENTION

Prior art FIG. 1 illustrates a graphics system 100 constructed in accordance with the prior art. As shown, such graphics system 100 includes a graphics processor 102, a frame buffer 104, an RGB look-up table 106, digital-to-analog converters 108, and a display device 110.

The graphics processor 102 traditionally may include a transform module, a lighting module, a rasterizer and/or any other components commonly utilized in a computer graphics pipeline. Together, such components may be dedicated to rendering picture element (pixel) data that is to be displayed on the display device 110. The pixel data that is displayed on the display screen may be stored in the frame buffer 104 of the graphics system 100 in a digital pixel format.

During operation, the contents of the frame buffer 104 repeatedly are read out of the frame buffer 104 for the purpose of looking up appropriate digital RGB values utilizing the RGB look-up table 106. Such digital values are then fed to the digital-to-analog converters 108, which convert the digital RGB values into analog representations of the colors red, green and blue in order to be shown on the display device 110. In the alternative, the digital values may be fed directly to a digital display device 110.

For pixels that encode color using separate red, green, and blue values, saturation is proportional to the difference between these three values. Increasing the difference, while keeping their average the same, increases saturation. Note Prior Art FIG. 2.

Many problems result from there being a lack of control of saturation and other graphics parameters such as sharpness in graphic systems. For example, display devices 110 are often utilized in lighted environments, e.g. offices, etc. When external light falls on the face of a display device 110, some reflects back and is added to the emitted image. This reduces contrast, sharpness, and saturation. Further, graphics-intensive applications such as games or the like are often developed utilizing high-quality graphics systems and monitors. In use, however, such graphics-intensive applications are usually executed utilizing lower quality hardware, thus affording lower graphics quality.

There is thus a need for improving display characteristics, i.e. saturation, sharpness, etc. inside a computer graphics pipeline.

DISCLOSURE OF THE INVENTION

A system, method and computer program product are provided for improving display characteristics in a computer graphics pipeline. Initially, color data is received from memory of the computer graphics pipeline. Thereafter, the saturation of the color data is altered in the computer graphics pipeline for improving display characteristics. Next, the color data is outputted for being displayed by a display device.

In one embodiment of the present invention, the color data may include a red value, a green value, and a blue value (RGB values). Further, the saturation of the color data may be altered utilizing the following equations:

$$\text{red value}=\text{red value}+(\text{red value}+\text{red value}-\text{green value}-\text{blue value})/2^n;$$

$$\text{green value}=\text{green value}+(\text{green value}+\text{green value}-\text{red value}-\text{blue value})/2^n;$$

and $$\text{blue value}=\text{blue value}+(\text{blue value}+\text{blue value}-\text{red value}-\text{green value})/2^n;$$

where n is selected from the group of numbers consisting of four (4), eight (8), and sixteen (16). One of the RGB values of the color data is thus altered based on the values of the remaining RGB values. It should be noted that the foregoing equations may include any arbitrary non-zero denominator. Optionally, the color data may be subsequently clamped based on a predetermined threshold.

In another embodiment of the present invention, the step of altering the color data may include sharpening the color data. As set forth earlier, the color data may include RGB values. Further, the color data may be sharpened by increasing a difference between a current, and previous and next values thereof.

These and other advantages of the present invention will become apparent upon reading the following detailed description and studying the various figures of the drawings.

BRIEF DESCRIPTION OF THE DRAWINGS

The foregoing and other aspects and advantages are better understood from the following detailed description of a preferred embodiment of the invention with reference to the drawings, in which.

Prior art

Prior art

DESCRIPTION OF THE PREFERRED EMBODIMENTS

Figure 1:
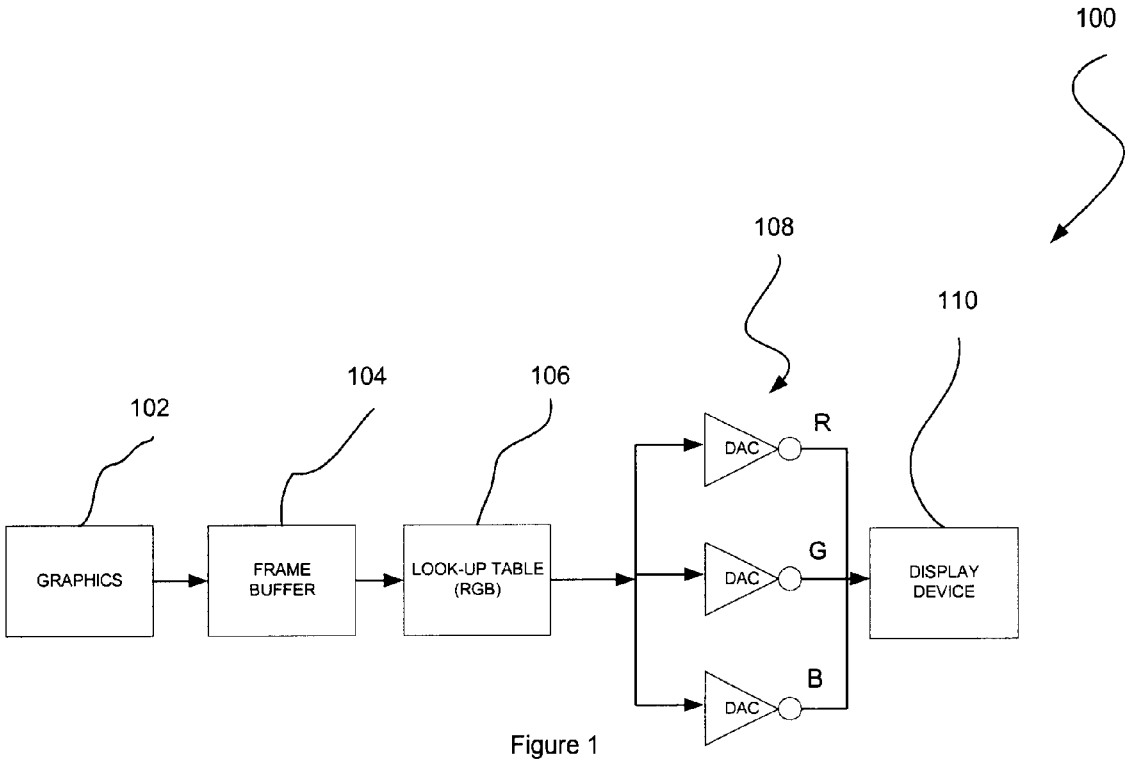
Figure 1 (Prior Art)
FIG. 1 illustrates a graphics system constructed in accordance with the prior art.
Figure 2:
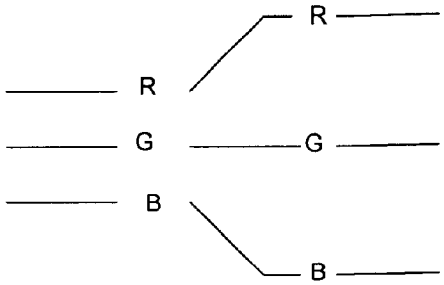
Figure 2 (Prior Art)
FIG. 2 illustrates the manner in which the RGB values may be manipulated in order to adjust saturation.
Figure 3:
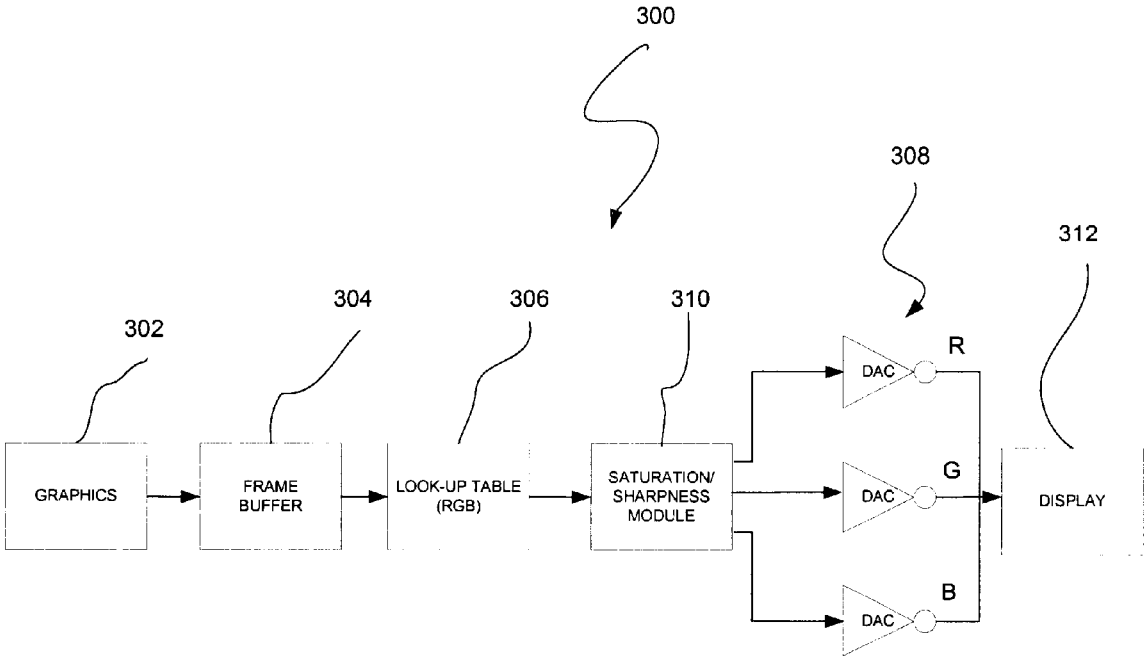
FIG. 3 illustrates a graphics system constructed in accordance with one embodiment of the present invention.

FIGS. 1 and 2 illustrate the prior art. FIG. 3 illustrates a graphics system 300 constructed in accordance with one embodiment of the present invention. As shown, such graphics system 300 includes a graphics processor 302, a frame buffer 304, a RGB look-up table 306, digital-to-analog converters 308, and a display device 312 which operate in a manner set forth earlier, and which is commonly known in the computer graphics arts.

With continuing reference to FIG. 3, a saturation/sharpness module 310 is coupled between the frame buffer 304 and the digital-to-analog converters 308, and is capable of interfacing with the RGB look-up table 306. In use, the saturation/sharpness module 310 is capable of altering the saturation and sharpness of the RGB values for improving display characteristics inside the computer graphics pipeline. Additional information regarding the operation of the saturation/sharpness module 310 will be set during reference to FIG. 4.

Figure 4:
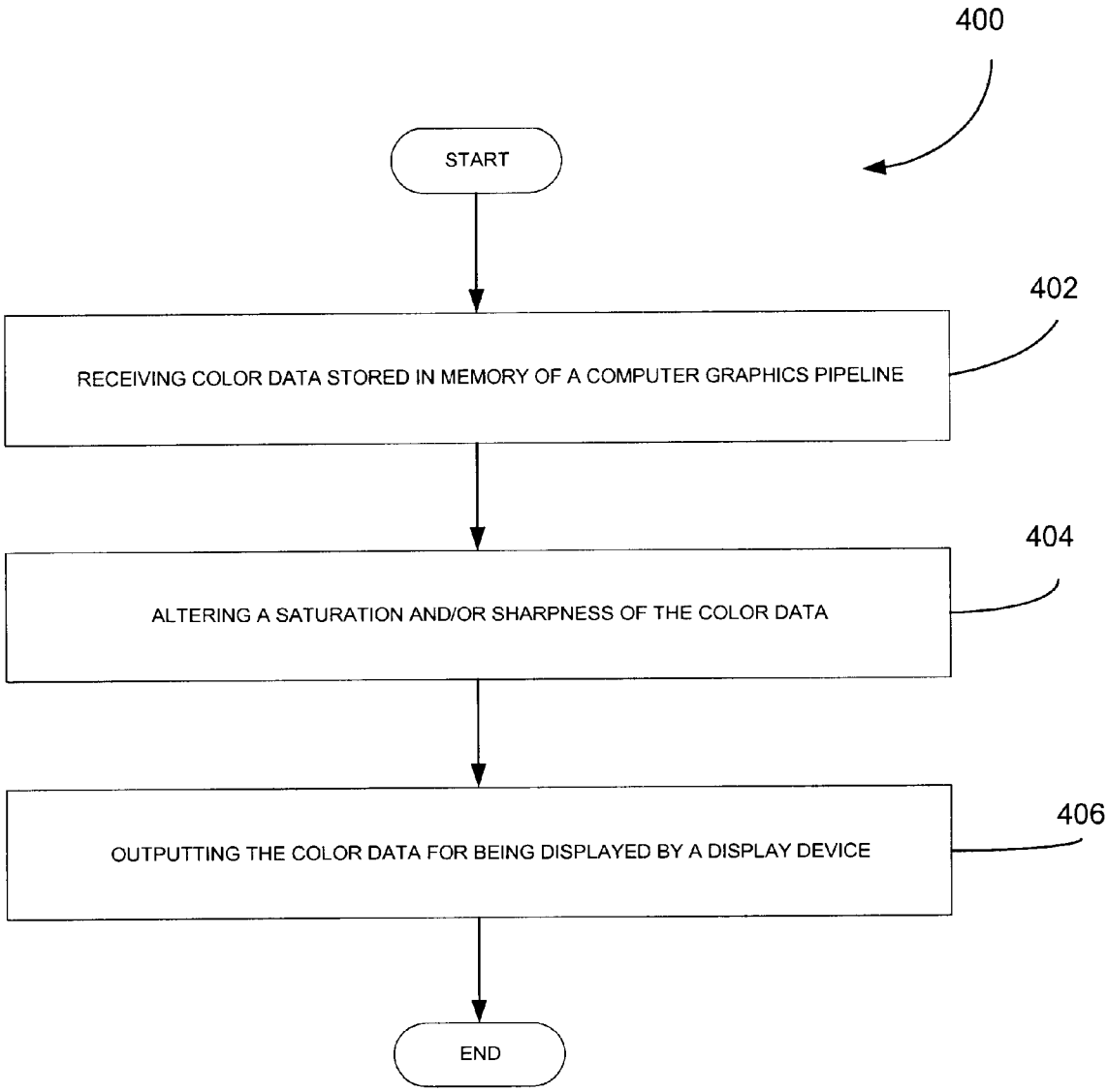
FIG. 4 illustrates a method for improving display characteristics in a computer graphics pipeline in accordance with one embodiment of the present invention.

FIG. 4 illustrates a method 400 for improving display characteristics in a computer graphics pipeline in accordance with one embodiment of the present invention. Initially, in operation 402, color data is received from memory of the computer graphics pipeline. Such memory may include the frame buffer 304 or the RGB look-up table 306. In one embodiment of the present invention, the color data may include a red value, a green value, and a blue value (RGB values).

Thereafter, in operation 404, the saturation and/or a sharpness of the color data is altered in the computer graphics pipeline for improving display characteristics. After operation 404, the color data is outputted for being displayed by a display device 312. See operation 406. With the RGB values being modified, they may be handled by the digital-to-analog converters 308 for converting the digital RGB values into analog representations of the colors red, green and blue for display on the display device 312. As an option, the color data may be directly outputted to a digital display device, i.e. flat panels, without the need for digital-to-analog conversion.

With respect to the saturation of the color data, any type of altering method may be employed. Table 1 illustrates equations associated with one exemplary altering technique.

TABLE 1

| |
|---|
| red value = red value + (red value + red value − green value − blue value)/$2^n$; |
| green value = green value + (green value + green value − red value − blue value)/$2^n$; and |
| blue value = blue value + (blue value + blue value − red value − green value)/$2^n$; |

where n is selected from the group of numbers consisting of four (4), eight (8), and sixteen (16). By altering the saturation of the contents of the display device 312 using the equations of Table 1, the saturation is 1.75×, 1.375×, and 1.188×, respectively. It should be noted, however, that the various equations of Table 1 may include any arbitrary non-zero denominator.

In some cases, the equations may result in RGB values that exceed 0–1023, resulting in problems in the graphics system utilizing a conventional 10-bit digital-to-analog converters 308. As such, the color data may be clamped based on a predetermined threshold, namely 0 and 1023.

Table 2 illustrates rules associated with one exemplary clamping technique.

TABLE 2

| |
|---|
| If (red value < 0), red = 0 |
| If (red value > 1023), red = 1023 |
| If (green value < 0), green = 0 |
| If (green value > 1023), green = 1023 |
| If (blue value < 0), blue = 0 |
| If (blue value > 1023), blue = 1023 |

In other words, the output is clamped to zero (0) if bits (10,9) are (1,1), and clamped to 1023 if the bits (10,9) are (1,0). It should be noted that the output may be clamped in various ways to accommodate different digital-to-analog converters 308.

Figure 5:
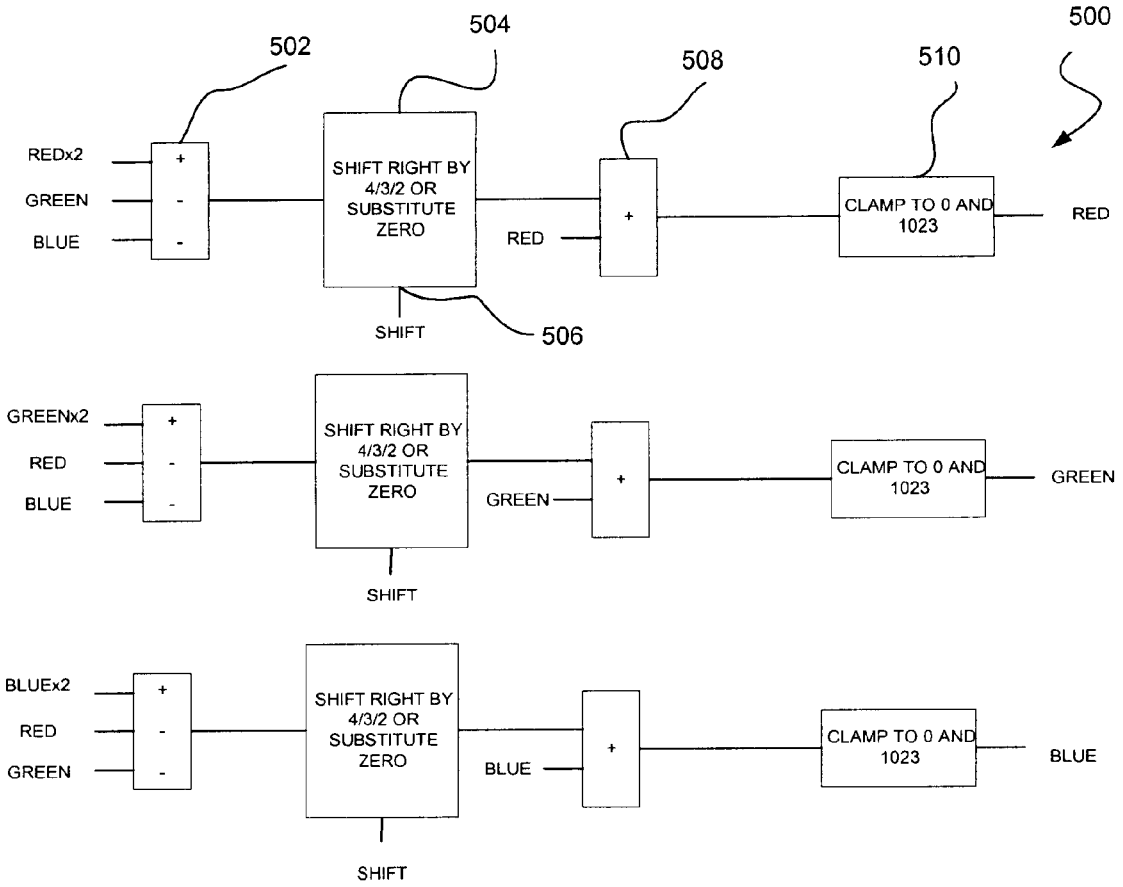
FIG. 5 is a schematic illustrating an exemplary architecture associated with the saturation/sharpness module shown in FIG. 3.

FIG. 5 is a schematic illustrating an exemplary architecture associated with the saturation capabilities of module 310. As shown, a plurality of calculation modules 500 are included each having a plurality logic units. Each calculation module 500 includes a first addition logic unit 502 for adding a multiple of a first one of the RGB values, and a negative of the remaining RGB values. As shown, the first RGB value is multiplied by two (2).

Also included is a shift logic unit 504 for dividing the output of the first addition logic unit 502 by four (4), eight (8), or sixteen (16). This is accomplished by shifting the output of the first addition logic unit 502 right two (2), four (4), or eight (8) places, respectively. The amount that the shift logic unit 504 shifts may be governed by a control terminal 506, in accordance with the equations set forth in Table 1.

With continuing reference to FIG. 5, further provided is a second addition logic unit 508 for adding the output of the shift logic unit 504 with the first RGB value. It should be noted that the logic units may be altered such that saturation is reduced instead of being boosted. This may be accomplished by simply replacing the addition and subtraction operations with subtraction and addition operations, respectively.

Thereafter, the output of the second addition logic unit 508 may need to be clamped to 0 or 1023 by a clamping unit 510 based on a value thereof, in accordance with the inequalities set forth in Table 2. As shown, a calculation module 500 is provided for each of the RGB values.

A manner in which the color data may be sharpened by module 310 in accordance with operation 404 of FIG. 4 will now be set forth. Perceived sharpness can be improved by increasing the difference between the RGB values of a pixel and their preceding and/or following neighbors in the video stream. By comparing a pixel value against the (possibly weighted) average of recent and/or subsequent pixels, and altering the value proportional to that difference (in such a way as to increase the difference), a pixel stream that appears sharper results. For example, one might replace the color value of a pixel by the weighted sum of the pixel before, itself, and the pixel after, using weights −1, +3, −1. Alternatively, two neighbors to each side and five weights can be used, perhaps with weights +1, 4, +7, −4, +1. In each case, one calculation produces one new value (done for red, green, blue separately).

In order to accomplish this, any logic unit configuration may be employed. In the case of the first example set forth hereinabove, a stream of pixel values may be fed to two successive registers for storing the previous and current values. Thereafter, the negated newly-arriving "next" value may be summed with 3 times the registered "current" value plus the negated registered (twice-delayed) "previous" value. A clamping unit may then be utilized for clamping purposes.

While various embodiments have been described above, it should be understood that they have been presented by way of example only, and not limitation. Thus, the breadth and scope of a preferred embodiment should not be limited by any of the above described exemplary embodiments, but should be defined only in accordance with the following claims and their equivalents.

What is claimed is:

1. A method for digitally improving display characteristics in a computer graphics pipeline, comprising:

receiving color data stored in memory of the computer graphics pipeline;

altering saturation of the color data utilizing a saturation module in the computer graphics pipeline; and outputting the color data to a digital-to-analog converter coupled between the saturation module and a display device for being displayed by the display device;

wherein the color data is clamped based on a predetermined threshold.

2. The method as recited in claim 1, wherein the color data includes a red value, a green value, and a blue value.

3. A method for digitally improving display characteristics in a computer graphics pipeline, comprising:

receiving color data stored in memory of the computer graphics pipeline;

altering saturation of the color data in the computer graphics pipeline; and outputting the color data for being displayed by a display device;

wherein the saturation of the color data is altered utilizing a plurality of equations including:

red value=red value+(red value+red value−green value−blue value)/*N;* green value=green value+(green value+green value−red value−blue value)/*N;* and blue value=blue value+(blue value+blue value−red value−green value)/*N;* where N is a non-zero number.

4. The method as recited in claim 3, wherein $N=2^n$, where n is an integer.

5. The method as recited in claim 4, wherein n is selected from the group of numbers consisting of four (4), eight (8), and sixteen (16).

6. The method as recited in claim 2, wherein the memory is selected from the group consisting of a frame buffer and a RGB look-up table.

7. A system for digitally improving display characteristics in a computer graphics pipeline, comprising:

memory in the computer graphics pipeline for storing color data;

a saturation module in the computer graphics pipeline for altering saturation of the color data in the computer graphics pipeline; and a digital-to-analog converter coupled between the saturation module and a display device for displaying the color data;

wherein the color data is clamped based on a predetermined threshold.

8. The system as recited in claim 7, wherein the color data includes a red value, a green value, and a blue value.

9. A computer program product for digitally improving display characteristics in a computer graphics pipeline, comprising:

computer code for receiving color data stored in memory of the computer graphics pipeline;

computer code for altering saturation of the color data in the computer graphics pipeline; and computer code for outputting the color data for being displayed by a display device;

wherein the saturation of the color data is altered utilizing a plurality of equations including:

red value=red value+(red value+red value−green value−blue value)/*N;* green value=green value+(green value+green value−red value−blue value)/*N;* and blue value=blue value+(blue value+blue value−red value−green value)/*N;* where N is a non-zero number.

10. The computer program product as recited in claim 9, wherein $N=2^n$, where n is an integer.

11. The computer program product as recited in claim 10, wherein n is selected from the group of numbers consisting of four (4), eight (8), and sixteen (16).

12. The system as recited in claim 8, wherein the memory is selected from the group consisting of a frame buffer and a RGB look-up table.

13. A system for digitally improving display characteristics in a computer graphics pipeline, comprising:

logic for receiving color data stored in memory of the computer graphics pipeline;

logic for altering saturation of the color data utilizing a saturation module in the computer graphics pipeline; and logic for outputting the color data to a digital-to-analog converter coupled between the saturation module and a display device for being displayed by the display device;

wherein the color data is clamped based on a predetermined threshold.

14. A method for digitally improving display characteristics in a computer graphics pipeline, comprising:

receiving color data stored in memory of the computer graphics pipeline;

sharpening the color data utilizing a sharpness module in the computer graphics pipeline; and outputting the color data to a digital-to-analog converter coupled between the sharpness module and a display device for being displayed by the display device;

wherein the color data is clamped based on a predetermined threshold.

15. The method as recited in claim 14, wherein the color data is sharpened by increasing a difference between a current value and a previous value thereof.

16. The method as recited in claim 14, wherein the color data is sharpened by increasing a difference between a current value and a next value thereof.

17. A system for digitally improving display characteristics in a computer graphics pipeline, comprising:

memory in the computer graphics pipeline for storing color data;

a sharpness module in the computer graphics pipeline for sharpening the color data in the computer graphics pipeline; and a digital-to-analog converter coupled between the sharpness module and a display device for displaying the color data;

wherein the color data is clamped based on a predetermined threshold.

18. The system as recited in claim 17, wherein the color data is sharpened by increasing a difference between a current value and a previous value thereof.

19. The system as recited in claim 17, wherein the color data is sharpened by increasing a difference between a current value and a next value thereof.

20. A system for digitally improving display characteristics in a computer graphics pipeline, comprising:

logic for receiving color data stored in memory of the computer graphics pipeline;

logic for sharpening the color data utilizing a sharpness module in the computer graphics pipeline; and logic for outputting the color data to a digital-to-analog converter coupled between the sharpness module and a display device for being displayed by the display device;

wherein the color data is clamped based on a predetermined threshold.

21. The system as recited in claim 20, wherein the color data is sharpened by increasing a difference between a current value and a previous value thereof.

22. The system as recited in claim 20, wherein the color data is sharpened by increasing a difference between a current value and a previous value thereof.

23. A method for digitally improving display characteristics in a computer graphics pipeline, comprising:

receiving color data stored in memory of the computer graphics pipeline;

altering saturation of the color data in the computer graphics pipeline; and outputting the color data for being displayed by a display device;

wherein the color data is clamped based on a predetermined threshold.

24. A method for digitally improving display characteristics in a computer graphics pipeline, comprising:

receiving pixel data from a rasterizer of the computer graphics pipeline, the computer graphics pipeline including a transform module, a lighting module and the rasterizer, the pixel data including color data;

storing the pixel data in memory of the computer graphics pipeline;

altering saturation of the color data in the computer graphics pipeline; and outputting the color data for being displayed by a display device.

25. A method for digitally improving display characteristics in a computer graphics pipeline, comprising:

receiving color data stored in memory of the computer graphics pipeline;

sharpening the color data in the computer graphics pipeline; and outputting the color data for being displayed by a display device;

wherein the color data is clamped based on a predetermined threshold.

26. A method for digitally improving display characteristics in a computer graphics pipeline, comprising:

receiving pixel data from a rasterizer of the computer graphics pipeline, the computer graphics pipeline including a transform module, a lighting module and the rasterizer, the pixel data including color data;

storing the pixel data in memory of the computer graphics pipeline;

sharpening the color data in the computer graphics pipeline; and outputting the color data for being displayed by a display device.

* * * * *